US008269798B2

(12) United States Patent
Miller et al.

(10) Patent No.: US 8,269,798 B2
(45) Date of Patent: Sep. 18, 2012

(54) REDUCED POWER CONSUMPTION IN OLED DISPLAY SYSTEM

(75) Inventors: Michael E. Miller, Honeoye Falls, NY (US); Andrew D. Arnold, Hilton, NY (US); John F. Hamilton, Jr., Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 934 days.

(21) Appl. No.: 11/779,417

(22) Filed: Jul. 18, 2007

(65) Prior Publication Data

US 2009/0021455 A1 Jan. 22, 2009

(51) Int. Cl.
*G09G 3/30* (2006.01)

(52) U.S. Cl. ..... 345/690; 345/204; 345/76; 345/691; 345/78; 315/169.3; 313/500; 313/505; 313/506

(58) Field of Classification Search ..... 345/691, 345/690, 76, 78, 204; 315/169.3; 326/82, 326/83; 313/486, 500, 505, 506, 507
See application file for complete search history.

(56) References Cited

U.S. PATENT DOCUMENTS

| | | | | |
|---|---|---|---|---|
| 5,844,368 | A | 12/1998 | Okuda et al. | |
| 6,594,606 | B2 * | 7/2003 | Everitt | 702/107 |
| 7,227,521 | B2 | 6/2007 | Yamazaki et al. | |
| 2002/0036605 | A1 * | 3/2002 | Kawashima | 345/76 |
| 2003/0169219 | A1 * | 9/2003 | LeChevalier | 345/84 |
| 2003/0223275 | A1 * | 12/2003 | Abe | 365/189.09 |
| 2004/0125046 | A1 * | 7/2004 | Yamazaki et al. | 345/1.3 |
| 2004/0160393 | A1 * | 8/2004 | Kato | 345/80 |
| 2004/0217926 | A1 * | 11/2004 | Kato | 345/76 |
| 2004/0233148 | A1 * | 11/2004 | Tanghe et al. | 345/83 |
| 2005/0052448 | A1 * | 3/2005 | Hayafuji et al. | 345/212 |
| 2005/0280766 | A1 * | 12/2005 | Johnson et al. | 349/167 |
| 2006/0055632 | A1 * | 3/2006 | Ha et al. | 345/46 |
| 2006/0125733 | A1 * | 6/2006 | Dagois | 345/76 |
| 2007/0046585 | A1 * | 3/2007 | Choi | 345/68 |

FOREIGN PATENT DOCUMENTS

| | | |
|---|---|---|
| EP | 1553551 | 7/2005 |
| EP | 1 739 650 | 1/2007 |
| WO | 2006/035246 | 4/2006 |
| WO | 2006/035248 | 4/2006 |
| WO | 2006/067520 | 6/2006 |

OTHER PUBLICATIONS

Yang et al.; P-41: PMOLED Driver Design With Pre-charge Power Saving Algorithm; SID 2006 Digest, pp. 347-350.
Soh et al.; Dependence of OLED Display Degradation on Driving Conditions.
"8.3: Total Matrix Addressing" by Euan C. Smith, SID 2007 International Symposium, pp. 93-95, May 20, 2007, XP007013404.

* cited by examiner

*Primary Examiner* — Lun-Yi Lao
*Assistant Examiner* — Priyank Shah
(74) *Attorney, Agent, or Firm* — Morgan, Lewis & Bockius LLP

(57) ABSTRACT

A method of controlling a passive matrix display having rows and columns of pixels including receiving an input image signal; determining drive signals for at least a first image field and a second image field; calculating a value that is correlated to a change in the total capacitive charge of the pixels that will occur between the display of the first image field and the second image field for at least one column of the passive-matrix, electro-luminescent display; adjusting at least one of the drive signals within first or second image fields to compensate for the change in total capacitive charge; and providing adjusted drive signals for each pixel.

20 Claims, 11 Drawing Sheets

REDUCED POWER CONSUMPTION IN OLED DISPLAY SYSTEM

CROSS REFERENCE TO RELATED APPLICATIONS

Reference is made to commonly assigned co-pending U.S. patent application Ser. No. 11/737,786, filed Apr. 20, 2007, by Michael E. Miller et al., entitled "Passive Matrix Electro-Luminescent Display System".

FIELD OF THE INVENTION

The present invention relates to passive matrix electro-luminescent display systems. More particularly, the present invention provides passive matrix electro-luminescent display system having reduced power consumption.

BACKGROUND OF THE INVENTION

Many display devices exist within the market today. Among the displays that are available are thin-film, coated, electro-luminescent (EL) displays, such as OLED displays. These displays can be driven using active matrix backplanes, which employ an active circuit. This active circuit controls the flow of current to each light-emitting element in the display. However, these displays tend to be relatively expensive due to the complexity of forming an active circuit at each light-emitting element and the thin film transistors that are often used within these active drive circuits are often prone to defects, such as lack of uniformity or threshold shifts over time, which degrade the quality of the display.

Passive-matrix, thin-film, coated, EL displays are much simpler in their construction. The display generally includes an array of row electrodes and an array of column electrodes. EL materials are deposited between these electrodes, such that when a positive electrical potential is created between the two electrodes, the EL material between these two electrodes emits light. Therefore each light-emitting element in the display is formed by the intersection of a row and a column electrode. As this type of display does not require the costly formation of active circuits at each pixel site, they are much less expensive to construct. In these devices, the column electrode is typically formed of ITO or some other material that is transparent but typically higher in resistivity than the row electrode, to allow light to be visible to the user.

Numerous passive matrix EL display systems have been described in the literature. For example Okuda et al. in U.S. Pat. No. 5,844,368, entitled "Driving System For Driving Luminous Elements" describes a system for driving a passive matrix EL display. In this method, and in most traditional passive matrix EL drive methods; it is assumed that a power is provided to one row electrode at a time and current flows through the EL material to each of the column lines. This method of driving the display by providing power to only one line of light-emitting elements leads to two significant problems.

The first of these two problems, occur because each display will ideally have hundreds of lines of light-emitting elements, which implies that each light-emitting element will only emit light for a very short period of time. Therefore each light-emitting element will be required to emit light with a very high luminance to achieve a reasonable time-averaged luminance value. Since light intensity from these devices is proportional to current, relatively high currents must be provided to each light-emitting element. This can significantly shorten the lifetime of the individual light-emitting elements and increase cross-talk between pixels in the display as described by Soh, et al, in a paper entitled "Dependence of OLED Display Degradation on Driving Conditions" and published in the proceedings of the SID Mid Europe Chapter in 2006. Further this drive method requires drive electronics to support high currents, which usually translate to larger, more expensive silicon drive chips; and leads to high resistive voltage and power losses across the electrodes, especially the row electrodes which provide current to potentially hundreds of light-emitting elements simultaneously. Typically, these devices further employ time division multiplexing, requiring that each electrode carry a peak current during the first portion of the lighting phase, further increasing the resistive power losses.

The second of these two problems occur because each light-emitting element must be turned on and off during each cycle to avoid current leakage, and therefore light emission, through light-emitting elements that are supposedly not activated. This problem is particularly troubling in EL displays employing organic materials since the EL layers are very thin and are highly resistive. In such displays, each light-emitting element has an effective capacitor having a significant capacitance that must be overcome before light emission can occur. Overcoming this capacitance can require significant power that does not generate light and is therefore wasted. This issue has been discussed by Yang et al. in a paper entitled, "PMOLED Driver Design with Pre-charge Power Saving Algorithm" as published in the 2006 SID Digest. As this paper states, this power increases significantly as the number of lines in the display is increased. Specifically, this paper points out that for a PMOLED having 64 lines, nearly 80% of the power is spent driving the OLED (i.e., for light production), while 20% of the power is spent overcoming this capacitance as the lines are turned on and off. As the resolution increases, this ratio changes dramatically, such that when there are 176 lines, only 57% of the power is spent in the production of light while 43% of the power is spent overcoming this capacitance. Therefore, the display becomes significantly less energy efficient, as more lines are present on the display to be cycled from off to on.

Each of these problems can significantly limit the use of passive matrix EL displays. However, in combination, these two problems limit the application space for such displays significantly. Today, the application of passive matrix EL displays are limited to displays that generally have less than 128 lines and are typically less than 1.5 inches in diagonal.

One category of approaches for addressing at least a portion of the first of these two problems is to provide multiline addressing of passive matrix EL displays. Such methods have the potential to reduce the peak current through any EL light-emitting element, which can extend the lifetime of the material and significantly reduce the drive voltage. Further, since multiple rows can be engaged simultaneously, the power losses due to the resistivity of the electrodes can be reduced significantly.

Yamazaki et al. in U.S. Pat. No. 7,227,521, entitled "Image Display Apparatus" provides one such multiline addressing method. While disclosed primarily for use in surface-conduction type electron emitting devices, this approach was also discussed for EL displays. In this approach, any input image signal that has fewer vertical addressable pixels than the vertical addressability of the display is displayed by receiving the input video signal, providing a horizontal edge emphasis process (i.e., edge sharpening) across the column direction of the display, selecting two or more rows of the display, and modulating the time that voltage is provided to the columns of the display in response to the processed input image signal.

This approach requires relatively straightforward image processing to prepare the image signal and is able to employ drivers that are very similar to existing passive matrix drivers. While this method can reduce the drive current and voltage as compared to a display employing one line at a time drive techniques as known in the prior art, simply providing the same signal on two neighboring lines, results in an image with a substantial loss in sharpness in the vertical direction and the edge emphasis process can provide only a limited level of enhancement. This method can be used to provide a lower power display when simultaneously selecting two rows of the display at a time. However, under certain circumstances it can be useful to select three or more rows at a time. Unfortunately, the number of rows that can be employed simultaneously without introducing significant levels of image blur is limited to 2 or perhaps 3 lines, using this technique. Further the system has the similar issues with charging and discharging the capacitor as the earlier disclosures.

Sylvan in EP 1 739 650, entitled "Procédé de pilotage d'un dispositif d'affichage d'images à matrice passive par selection multilignes" has proposed an enhancement to this method in which multiple rows are selected during one refresh of the display but a single row is selected during subsequent display refresh cycles. This approach overcomes at least a portion of the sharpness issues that can occur using Yamazaki's approach but requires that the display actually be cycled more often, further increasing the number of charge and discharge cycles and therefore increasing the power to charge or discharge the capacitors. Eisenbrand et al. discusses a similar approach in a paper entitled "Multiline Addressing by Network Flow". This approach allows some cycles to be completed using even more rows simultaneously but employs a hierarchical approach that once again requires the use of an increased number of charge and discharge cycles.

Smith et al. have more recently discussed a different approach in PCT filings WO 2006/035246 entitled "Multi-Line Addressing Methods And Apparatus", WO 2006/035248 entitled "Multi-Line Addressing Methods And Apparatus" and WO 2006/067520 entitled "Digital Signal Processing Methods and Apparatus". These disclosures provide a method for decomposing an input image into subframes, using mathematical methods such as singular value decomposition and then displaying these subframes by controlling multiple rows and columns in an emissive display simultaneously. An interesting difference between this approach and the prior approaches is that the prior approaches provided only a single scan signal value to the selected row columns and typically provided a digital time multiplexed signal to the columns. The approach provided by Smith requires that multiple drive levels be provided on both the column and row electrodes. In fact, the method as described requires full analog control over the signals provided on the row and column electrodes and possibly requires that the current to each of these electrodes be controlled. While this adds complexity to the drivers, it also allows more control that can be used to engage more rows simultaneously with fewer artifacts. Unfortunately, the methods described in each of the disclosures by Smith, suffer from a number of shortcomings. Most importantly, the decomposition methods described are complex and difficult to realize in real time at a reasonable cost, especially when processing full frames of video information. Further, the approach provided by Smith does not directly address the reduction of the power required to overcome capacitance or methods to reduce power losses due to resistance of the row or column electrodes. In fact, this method often increases the peak currents on the column electrodes and can increase the peak current provided on row electrodes.

SUMMARY OF THE INVENTION

In accordance with the present invention, there is provided a method for controlling a passive matrix display having rows and columns of pixels.

This object is achieved by a method of including receiving an input image signal; determining drive signals for at least a first image field and a second image field; calculating a value that is correlated to a change in the total capacitive charge of the pixels that will occur between the display of the first image field and the second image field for at least one column of the passive-matrix, electro-luminescent display; adjusting at least one of the drive signals within first or second image fields to compensate for the change in total capacitive charge; and providing adjusted drive signals for each pixel.

The present invention reduces the power loss due to charging and discharging the capacitors of the display and the associated IR drop along the row and column electrodes. The present invention can enable higher resolution, larger, and more valuable passive matrix, electro-luminescent displays.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

The need is met by providing a method for driving a passive matrix display and a passive matrix, electro-luminescent (EL) display system for receiving an input image signal, processing such input image signal, and displaying such processed image with reduced power consumption.

Figure 3:
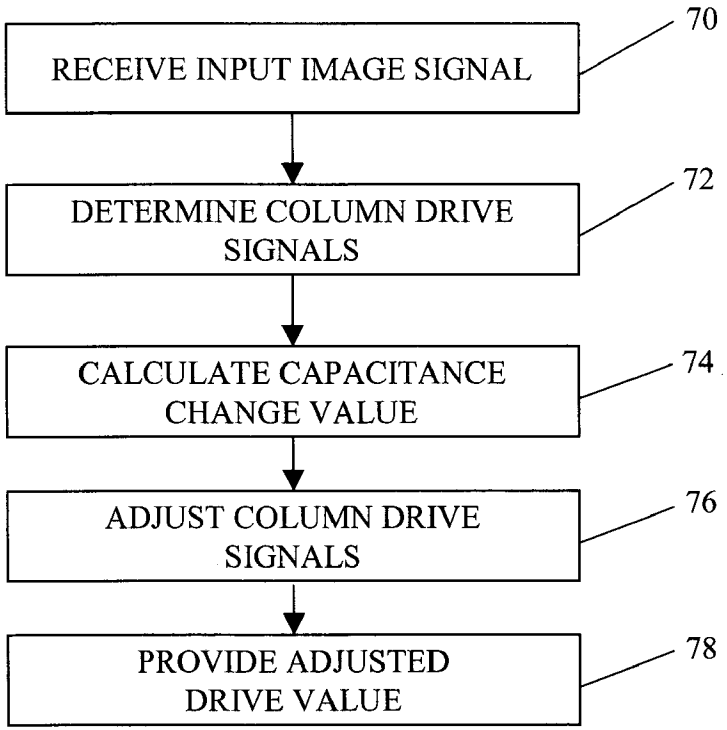
FIG. 3 is a flow diagram indicating the steps of the present invention.

The method for controlling a passive matrix display having rows and columns of pixels includes the processing steps shown in FIG. 3. As shown in FIG. 3, this method includes the steps of receiving 70 an input image signal; determining 72 drive signals for at least a first image field and a second image field; calculating 74 a value that is correlated to a change in the total capacitive charge of the pixels that will occur between the display of the first image field and the second image field for at least one column of the passive-matrix, electro-luminescent display; adjusting 76 at least one of the drive signals within first or second image fields to compensate for the change in total capacitive charge; and providing 78 adjusted drive signals for each pixel. This method is especially useful for providing a passive matrix display having high image quality and reduced power consumption when each of the pixels in the display has an inherent capacitor having a capacitance. For instance this method may be particularly useful in passive matrix electro-luminescent (EL) display systems such as the one shown in FIG. 1.

As shown in FIG. 1, a system of the present invention will include a passive matrix EL display 2, one or more row drivers 4, one or more column drivers 6, and a display driver 8. The passive matrix, EL display 2 will include an array of column electrodes 10, an array of row electrodes 12 oriented orthogonal to the array of column electrodes and an electro-luminescent layer located between the array of column electrodes and the array of row electrodes, the intersection of each column and row electrode forms an individual light-emitting element 14. This individual light-emitting element will alternatively be referred to as a pixel within the remainder of this disclosure.

Figure 1A:
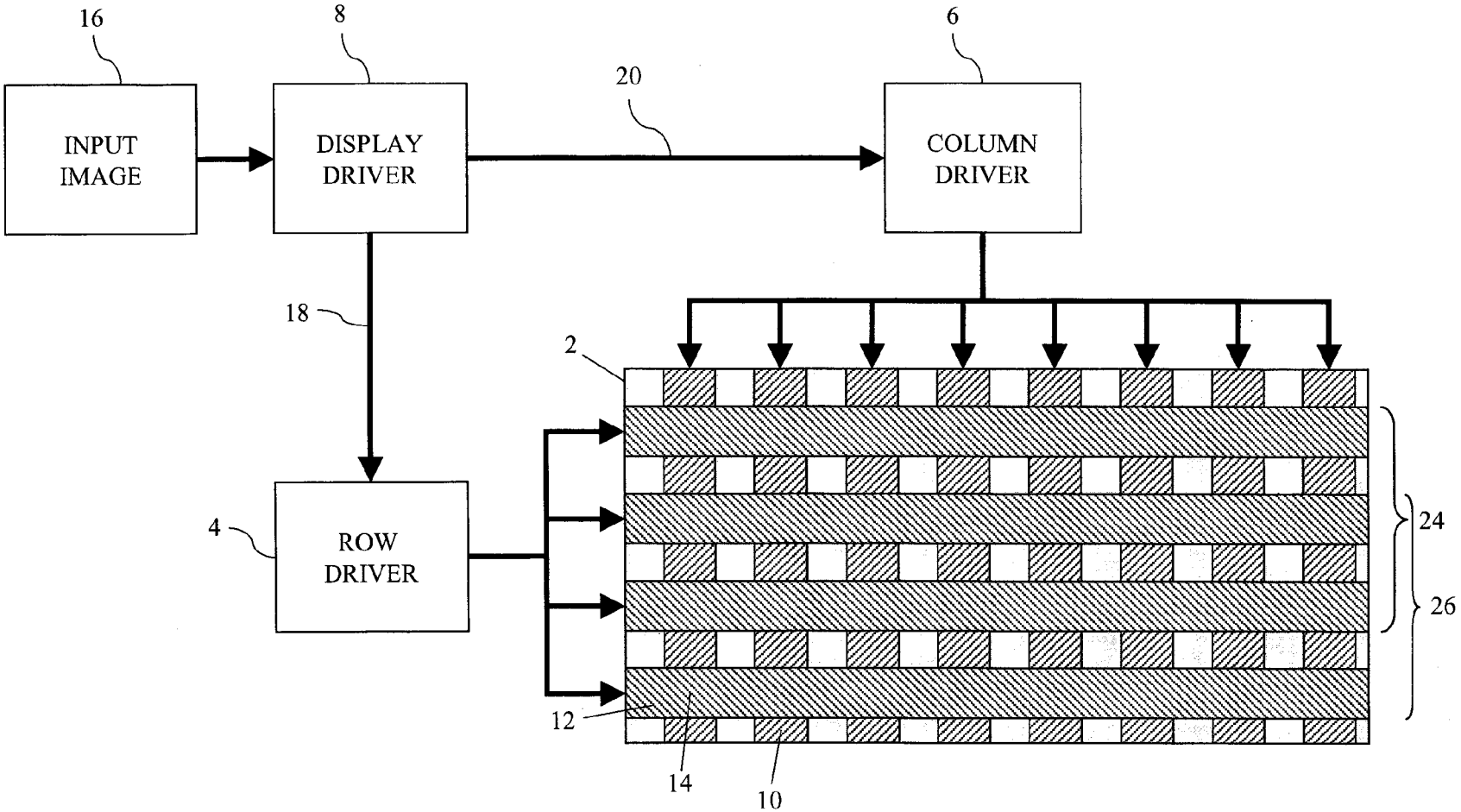
FIG. 1*a* is a schematic diagram depicting the components of the system of the present invention.
Figure 1B:
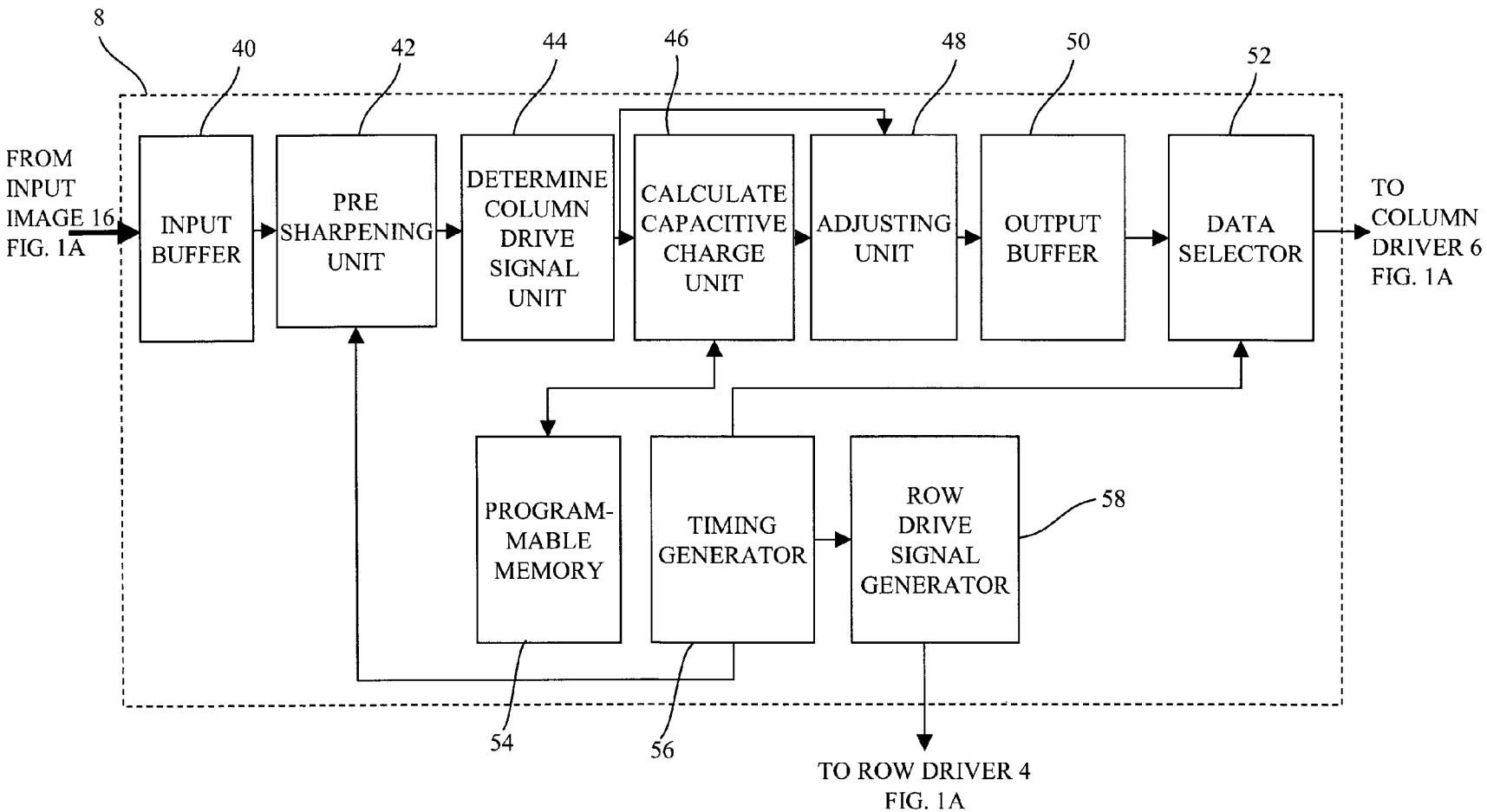
FIG. 1*b* is a schematic diagram of a display driver useful in executing the display driving method of the present invention.
Figure 2:
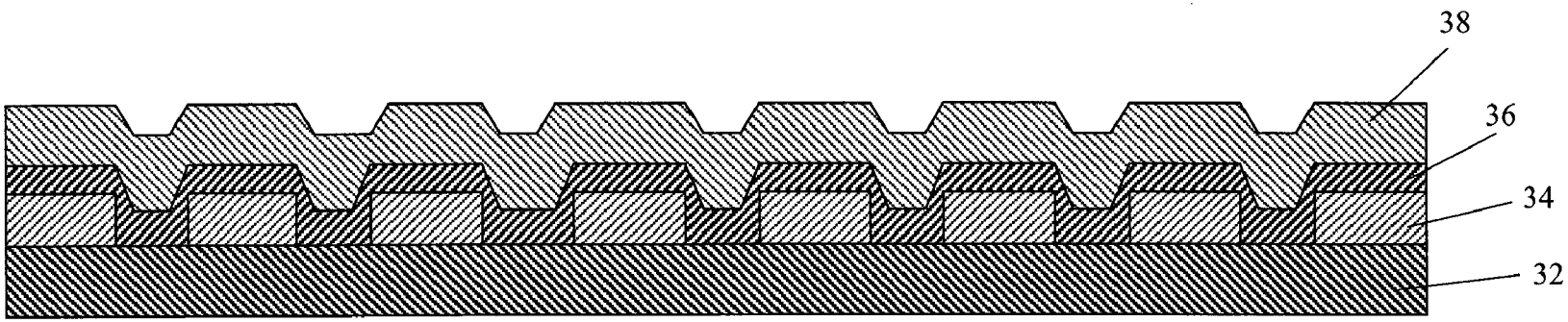
FIG. 2 is a cross-sectional diagram of a typical passive matrix, electro-luminescent display of the present invention.

In embodiments of the present invention, the passive matrix, EL display 2 will typically include the cross-sectional layers shown in FIG. 2. As shown in this figure, the EL display will include a substrate 32, a first electrode layer 34, which can form the column electrodes, a light-emitting layer 36 and a second electrode layer 38, which can for example form the row electrodes. As is well known in the art, the effective capacitance of a device is a function of the separation of a pair of metal plates and the dielectric constant of the material between the metal plates. It is significant that in embodiments of the present invention, the light-emitting layer will typically be less than 5000 Angstroms in thickness and that this layer will typically have a dielectric constant greater than 2, and often on the order of 3. As such, an effective capacitor will be formed at the junction of the row and column electrodes, which will typically have a capacitance of at least 50 pF per square mm. For many embodiments, for example those including organic electro-luminescent materials, the capacitance can exceed 200 pF per square mm and will often be on the order of 300 pF per square mm. Therefore, an effective capacitor will be formed within each light-emitting element, which will have an inherent capacitance. In devices of the present invention, it will therefore, be necessary to charge the capacitor of each light-emitting element before it will be capable of emitting light. When this element is emitting light, it will have a capacitive charge, which will discharge when the electric potential is removed from between the row and column electrodes. It should be noted that the device shown in FIG. 1*b* may emit light through the first electrode layer and the substrate, forming a bottom-emitting OLED, as is commonly practiced within the industry. However, the device may also emit light through the second electrode layer, forming a top-emitting OLED display. Further either first or second electrode layers may serve as the cathode or the anode within the device, as is well known within the art.

Within this invention, the row drivers 4 can be designed to receive current from one or more row electrodes 12 within the array of row electrodes. In particular embodiments of the present invention, the row driver 4 will employ a current sink such that it can receive a programmable amount of current. Typically, the row driver will provide a digital to analog conversion function, converting digital signals from the display driver 8 to analog signals to be provided on the row electrodes.

The one or more column drivers 6 will provide current to the column electrodes 10 within the array of column electrodes. These column drivers 6 can provide current using time division multiplexing to control total electrical charge to each column electrode 10 within the passive matrix EL display 2. In an alternative embodiment, the column drivers 6 can include a programmable current source to provide a programmable amount of current to modify the total electrical charge to each column electrode 10. Typically, the column drivers will also provide a digital to analog conversion function and will convert timing and control signals from the display driver 8 to analog signals on the column electrodes.

It should be noted that the notation of row and column drivers are chosen for convenience. However, one skilled in the art will recognize that the functions can be rotated, such that the driver attached to the vertical columns within the display will provide the function of the row driver. However, typically, the row driver will be attached to the electrode having the lower resistivity of the row and column drivers. This electrode will typically be formed from a reflective metal or metal alloy but can be formed from any conductive material. The column drivers will typically be attached to electrodes having some degree of transparency, such as Indium Tin Oxide (ITO), Indium Zinc Oxide (IZO) or a very thin metal layer, which will typically have a higher resistivity than the electrode formed from a reflective metal or metal alloy. It should also be noted that the functions of both the column and row driver could be integrated into a single device or shared among numerous devices.

In addition the passive matrix, electro-luminescent display system will include a display driver 8, as shown in FIG. 1 for receiving the input image signal 16, as shown in FIG. 1 and processing this input image signal 16 to provide drive signals 18, 20, as shown in FIG. 1 to each of the row 4 and column 6 drivers, respectively. Within the present invention, the display driver 8 will provide signals to the one or more column drivers 6 corresponding to the electrical charge to be provided by the column driver during the display of a plurality of image fields and may additionally provide signals o the one or more row drivers 4. Specifically, the display driver 8 will perform the steps shown in FIG. 3. As shown, these steps include, receiving 70 the input image signal 16. Based upon this image signal, determining 72 column or row drive signals for at least a first image field and a second image field. The processor then calculates 74 a value that is correlated to a change in the total capacitive charge of the pixels within at least one column of the passive matrix electro-luminescent display 2. Based upon the calculated value, the display driver then adjusts 76 at least one of the column or row drive signals within the first or second image field to compensate for the change in electrical charge that that is necessary to compensate for the total capacitive charge of a column of the display device. Finally, the display driver 8 provides 78 an adjusted column drive signal to the column driver for each pixel within each image field.

A schematic drawing of a display driver 8 that is useful for performing the steps of FIG. 3 is provided in FIG. 1*b*. Although the process provided in FIG. 3 can be applied in passive matrix drivers employing single line or multiple line addressing, it can be particularly advantageous in drivers employing multiline addressing. The display driver depicted in FIG. 1*b* therefore displays an embodiment that is useful for multiline addressing, particularly in employing the multiline addressing method described in described in co-pending U.S. patent application Ser. No. 11/737,786, filed Apr. 20, 2007, entitled "Passive Matrix Electro-luminescent Display System", to Michael E. Miller et al., which is incorporated herein by reference.

The display driver 8 can be any digital or analog device capable of performing the steps shown in FIG. 3. This display driver 8 can be embedded in a higher-level processor, for instance it can be embedded within the primary digital signal processor of a cellular telephone or a digital camera. The display driver 8 can alternatively be a stand-alone device, such as a stand-alone digital signal processing ASIC or field programmable gate array. As shown in FIG. 1*b*, the display driver 8 will receive an input image signal into an input buffer 40. In a desirable embodiment, the display driver 8 will include an input buffer. While this input buffer will not be required for some embodiments, such as those that employ one line at a time addressing, it will be useful within many desirable embodiments. This memory will buffer enough data to allow some preprocessing of the input image signal. For example, a presharpening unit 42 can be employed to perform some preprocessing. In one desirable embodiment, this presharpening unit 42 can presharpen the input data across multiple rows of input data. The presharpening unit 42 will sharpen this data across rows. This process will output one row of data at a time, wherein the row of data represents the data necessary to provide one image field. Again this presharpening unit 42 is not required within this invention but is useful with a particular embodiment. The data will then be processed by the determine column drive signal unit 44, which will perform additional operations, such as de-gamma or other tone or color manipulations that will be necessary to determine the column drive signal for each input data value. This data will be provided to the calculate capacitive charge unit 46 and the adjusting unit 48.

Once this step is performed, the calculate capacitive charge unit 46 will perform the calculations necessary to determine the capacitive charge of the display for a first row of data, representing the first image field of data. This calculate capacitive charge unit 46 will then receive a second row of data representing a second image field of data and perform the same calculation to determine the electrical charge necessary to charge the capacitors of one or more of the column of light-emitting elements. Finally, this unit 46 will perform a differencing operation to determine the change in total capacitive charge that will occur for each column of the display as the display transitions between the first and second image field of data. This change in total capacitive charge will then be communicated to the adjusting unit 48. It should be noted that to perform this operation, the calculate capacitive charge unit 46 will require certain information about the display, such as a curve representing the transform between current and voltage of the light-emitting diodes of the display, the effective capacitors of each light-emitting element and enough information about the drive scheme to estimate the voltage across the inactive light-emitting elements of the display. This information can be stored in a programmable memory 54 within or otherwise accessible by the display driver 8.

The adjusting unit 48 will then apply the change in capacitive charge to adjust the column drive. In this way, luminance errors, which would occur if a portion of the charge that is provided to the display is consumed by the capacitors or discharged from the capacitors as the display switches from frame to frame, will be avoided. The resulting adjusted column drive signals will then be written to an output buffer 50. This output buffer can store enough image fields of data to provide an entire frame of data. This buffer enables the use of a lower frequency input image signal than the output frequency from the display driver 8 such that the display driver can provide an output signal 20 with a high enough clock rate to enable a flicker-free display. A data selector 52 will then access data from the output buffer 50 in response to a signal generated by the timing generator 56 and provide the data to the column driver 6. A row drive signal generator 58 will provide synchronous signals 18 to the row driver 4. It should be noted that while the output buffer 50 and data selector 52 will generally be required, they could physically reside in either the display driver or the column driver 6.

By adjusting the column drive signal 20 and the signals delivered to the column electrodes 10 for the change in total capacitive charge within each column, it is possible to drive the passive matrix electro-luminescent display 2 without errors due to changes in these capacitive charge values. This capability then eliminates the need to precharge and discharge the capacitors of the display between the presentations of each image field. This change in the method to drive the display has multiple positive effects. First, it eliminates the need to charge and discharge the capacitors after each image field, thereby eliminating the need for most of the power required to overcome the capacitance of these passive matrix electro-luminescent displays. Secondly, because this charge and discharge power is not provided, the resistive losses that typically occur while providing this charge and discharge power is eliminated, further reducing the power consumed by the display. Finally, the drive signals for lighting the display can now be provided over the entire image field time, as it is no longer necessary to reserve a fraction of the image field time for display precharge and discharge. This then reduces the peak current that must be provided through the electrodes and the pixels. As a result, the resistive losses that occur over this time are reduced and, furthermore, by reducing the peak current the lifetime of the thin film electro-luminescent layer 36 will typically be improved.

Within the present invention, it is important to define the terms "image field" and "frame". Within the context of the present invention, an image field refers to a single lighting event for the passive-matrix, EL display 2. That is, any time that one or more light-emitting elements are simultaneously lit, a image field is displayed. A second image field is then displayed anytime one or more different light-emitting elements are lit. Typically, one or more rows of light-emitting elements will be turned off and one or more rows of light-emitting elements will be turned on during the transition between one image field and a second image field. A frame then refers to a group of lighting events or image fields that are displayed to draw a single image onto the display. Within the present invention, the display will typically display a number of image fields that are equal to the number of rows on the display to form a frame. The image field time then refers to the time to display a frame, divided by the number of image fields. Notice that by this definition, that the image field time includes the transition times between image fields. In traditional passive matrix EL displays, the image field time would typically include a time interval for precharging the capacitors of the display, a time interval for lighting the display and a time interval for discharging the capacitors of the display, however, within at least some embodiments of the present invention, these precharge and discharge time intervals will not be required.

Figure 4:
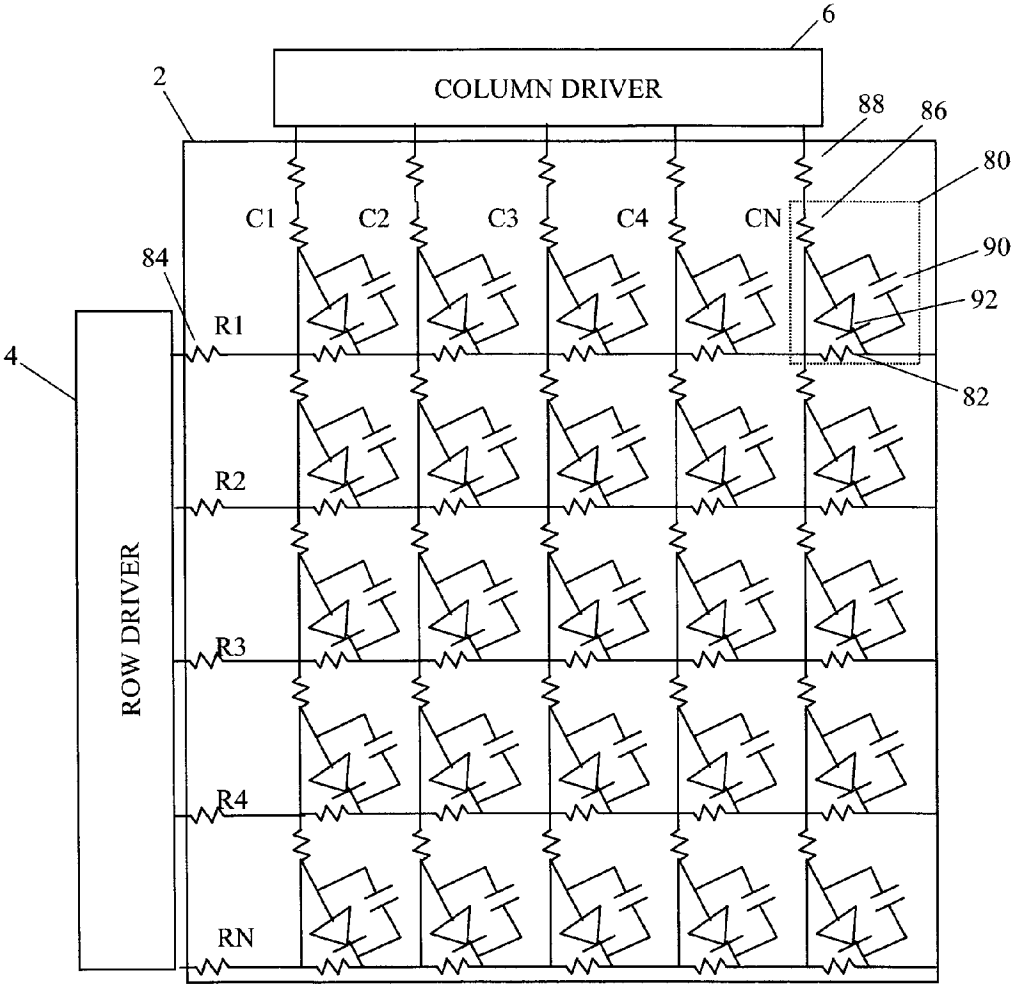
FIG. 4 is a circuit diagram of a typical passive matrix electro-luminescent display of the present invention.

To understand the present invention, it is important to understand the basic electrical components of a passive matrix electro-luminescent display. One diagram of the relevant electrical components are shown in FIG. 4. This figure depicts a display 2 with an associated row driver 4 and column driver 6. The display includes an array of pixels 80. These pixels are each defined by the intersection of a row 12 and column 10 electrodes. The row electrodes in FIG. 4 are denoted by R1 through Rn and the column electrodes are denoted by C1 through Cn. Each of these row electrodes can be electrically modeled as a number of resistors 82 placed in series, where each of the series resistors is the portion of the electrode within the pixel 80 and a resistive lead 84, which extends from the row driver 4 to the first pixel in each row. Similarly, the column electrodes can be modeled as a number of resistors 86 placed in series and a resistive lead 88, which extends from the column driver 6 to the edge of the panel. Each pixel additionally contains a capacitor 90 and a diode 92, which are placed in parallel with one another. These two components indicate the electrical behavior of each light-emitting element, the capacitor representing the effective capacitors created between the row and column electrodes, and the diode representing the electrical properties of the light-emitting diode.

Figure 5:
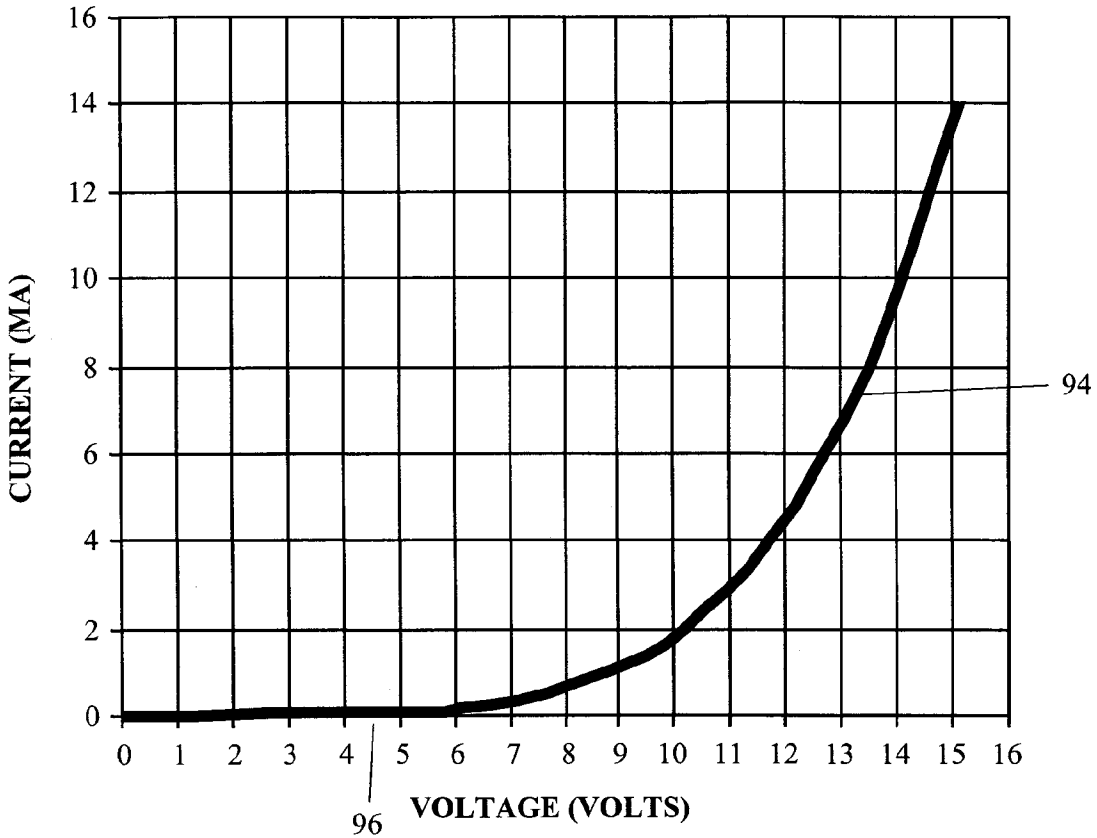
FIG. 5 is a plot of the voltage to current relationship for a typical diode response in an electro-luminescent display of the present invention.

Within these devices, the light-emitting diode will typically exhibit a voltage to current relationship as shown in FIG. 5. The curve 94 represents the current as a function of voltage across the device. Notice that these devices will typically exhibit a threshold voltage 96 below, which, little or no current will flow through the light-emitting diode and above which, the rate of current flow increases as a function of an increase in voltage. Often this curve 94 can be fit using power or exponential functions. It is also important to understand that there is typically also a relationship between the current flow through such a diode and the luminance output of the diode. Generally, this relationship can be described using a straight-line function.

Notice that in passive matrix electro-luminescent displays of the present invention, the input image signal 16 will often include code values, which imply relative luminance values to be displayed. Knowing the desired peak luminance of the display and information about the drive method used to drive the display device, the desired luminance of each pixel 80 can be calculated from the code value by computing the ratio of the code value to the peak display luminance and then multiplying the resulting value by the proportion of the luminance expected from any pixel divided by the proportion of the time that the pixel will be active. Note that if the pixel is on for multiple image fields, as is typical in multi-row drive schemes, this value may further consider this factor by adding the luminance over the multiple row times. Knowing this desired luminance, the desired current can be calculated using the relationship between luminance and current. Finally, knowing the desired current, the desired voltage across any active light-emitting element can be calculated using a functional relationship fit to the curve 94, relating these entities. Based upon the drive voltage and the capacitance of the capacitor 90 for each pixel, the total charge required to charge the capacitor such that the desired drive voltage can be attained can be calculated using the relationship that the total charge is equal to half the capacitance times the square of the voltage. Therefore, it is possible to calculate the electrical charge required to charge the capacitor of the active pixels within any time interval. However, it is also necessary to calculate the total charge required to charge the capacitor of the inactive pixels. Knowing the row voltage values, it is then possible to calculate the column voltages at each of the active pixels. To perform this calculation, it can be considered that some of this voltage will be lost to resistance at each pixel (active or inactive) and therefore, it is necessary to account for this resistive loss. Knowing the current through the active pixels, the voltage loss due to resistance can be calculated by estimating that the voltage drop is equal to the resistance of the row resistor 82 or column resistor 86 for any pixel in the display, allowing voltage values on each of the row and column electrodes to be calculated independently and providing voltage values for the off pixels to allow the total charge required to charge each of the capacitors 90 of the display 2 to be calculated. Within the present invention, the total charge will be calculated 74 for all of the pixels within each column. The change in this total charge from image field to image field will then be used to adjust 76 for the change in capacitive charge.

It is relatively straightforward to adjust the drive signal for an increase in total charge required to overcome the capacitance of the pixels in the display 2 by increasing the voltage or current provided by the column drivers. To accomplish this the change in capacitive charge between the first and second image fields is determined for each column by the calculate capacitive charge unit 46 as described earlier. The adjusting unit 48 then calculates the change in the column drive signal that is necessary to provide the charge necessary to increase the total charge provided by the column driver 6 during the second image field by the amount necessary to overcome the change in capacitive charge. The adjusting unit 48 then increases the column drive signal by this amount. Typically, this will be performed independently for each column of the passive matrix display for each subsequent image field.

A method to adjust for a decrease in this total charge is less straightforward. To understand this problem, assume that the pixels in one of the columns the display 2 of FIG. 4 is switched from providing one row of high luminance pixels during a first image field to providing a totally black image field within a second image field. Under these conditions, the voltage for the high luminance pixel will be higher than for the off pixels during the first image field. However, when the display is transitioned to all black, the total charge stored in the capacitor of a prior art display will be higher than is required. To discharge the capacitor, current will therefore flow through any row of pixels that is selected during the second image field time, even though these pixels are intended to emit no light. Since luminance is linearly proportional to current, this pixel, which is intended to have zero luminance, will have a measurable and observable luminance, creating an imaging artifact.

Figure 6:
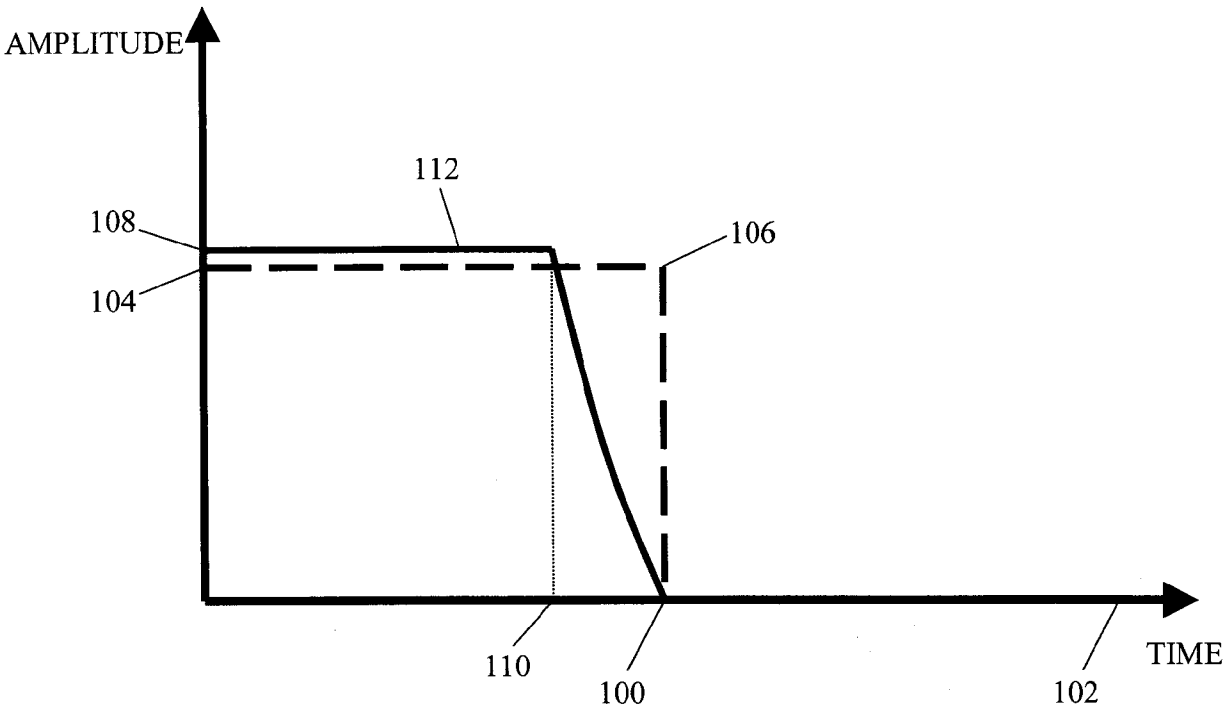
FIG. 6 is a plot of the current flow through a light-emitting element when driven using two different column drive sequences.

This problem can be overcome in the present invention, as it is possible before the first image field is displayed to determine that an excessive charge will be present for the subsequent frame and to modify the driving behavior of the first image field to adjust for this excessive capacitive charge. The current passing through the active pixel during the two image fields can be as depicted in FIG. 6 for one embodiment of the prior art as well as for one embodiment with such a modified driving behavior. Notice that this figure shows the amplitude of the current as a function of time. A time 100 is shown, indicating the end of the first image field. At this time, the row drive signal is changed such that it activates a different row electrode or group of row electrodes. Also shown is a time 102, indicating the end of the second image field. Using a traditional drive method of the prior art, an active drive signal will be provided by the column driver to provide a current of a given amplitude 104 through a first pixel along a row electrode during a first image field. This pixel would therefore receive the same current amplitude 104 for the entire image field time as indicated by curve 106. At the end of the image field time 102, the column driver will stop providing current and the row driver will deactivate the row electrode of the pixel that is lit during the first image field time. A row driver of the prior art could also activate the row electrode of a subsequent row electrode. In this scenario, the pixel that was active during the first image field time has a high voltage across it to allow it to produce light. However, since the diode and capacitor within each pixel are parallel, a high voltage must be placed across the capacitor to create a high voltage across the diode and therefore, the pixel will have a capacitive charge. When the next row electrode is selected during the subsequent image field, this capacitive charge will be dissipated through the neighboring pixel, even though this neighboring pixel can have a zero code value, indicating that it is to produce no light. However, as this charge is dissipated through the neighboring pixel, the current flow will produce light resulting in the imaging artifact. For this reason, passive matrix EL displays of the prior art discharge the capacitive charge of each of the capacitors in the entire panel at the end of each image field to avoid this artifact and then recharge the capacitors during the subsequent image field. While this behavior effectively avoids the artifact, it results in an amount of wasted power that is proportional to the capacitance of each pixel.

To properly adjust for this, the pixel to be lit during the first image field time is provided a second current amplitude 108. The column driver provides this same current for a time 110, which is shorter than the entire image field time to allow the current through the pixel to follow the relationship 112. Notice that because the column driver actively provides current for only a portion of the image field time and that the row electrode or group of row electrodes that are selected during the first image field time are active for a longer time 100 that is equal to the image field time, the capacitive charge of the pixel can discharge through this pixel and produce light. Ideally, the current provided during the first image field during the active drive cycle will be reduced in proportion to the change in capacitive charge, such that the total light output of the light-emitting element during the first image field would equal the desired light output and the capacitor would be fully discharged before the subsequent image field is displayed, so as to avoid artifacts. In fact, the exponential decay in current that is displayed after the time the active drive 110 is removed occurs as the capacitor of the pixel is discharged. In practice, at least some of the total charge will be dissipated through the desired light-emitting element and its drive level will be adjusted to account for the additional luminance to reduce any imaging artifacts without actively discharging and charging the capacitors of the passive matrix EL display.

In these scenarios, the display will be driven to allow the electrical charge of the display to dissipate through the desired pixel as the capacitive charge is reduced. The use of such a method will result in an image dependent display behavior. To understand this behavior, we will assume the display of two different image patterns. In a first image pattern, a white line will be displayed in both a first and a second image field. In a second image pattern, a white line will be displayed in the first image field, followed by a black line in the second image field. Note that in the first example, there is no need to discharge the capacitive charge of the effective capacitors within each pixel before the beginning of the second image field. Therefore, the current is maintained at a peak value over the entire image field time, resulting in a first total electrical charge during this first image field. However, when a white line is presented in a first image field, followed by a black line in a second image field, the capacitive charge of the effective capacitors within at least some of the pixels must be discharged before the black line is displayed. Therefore, the current can be reduced prior to the end of the image field time and the total electrical charge provided by the column drivers during the first image field when displaying the second image pattern will be lower than the total electrical charge provided by the column drivers during the first image field when displaying the first image pattern.

Figure 7A:
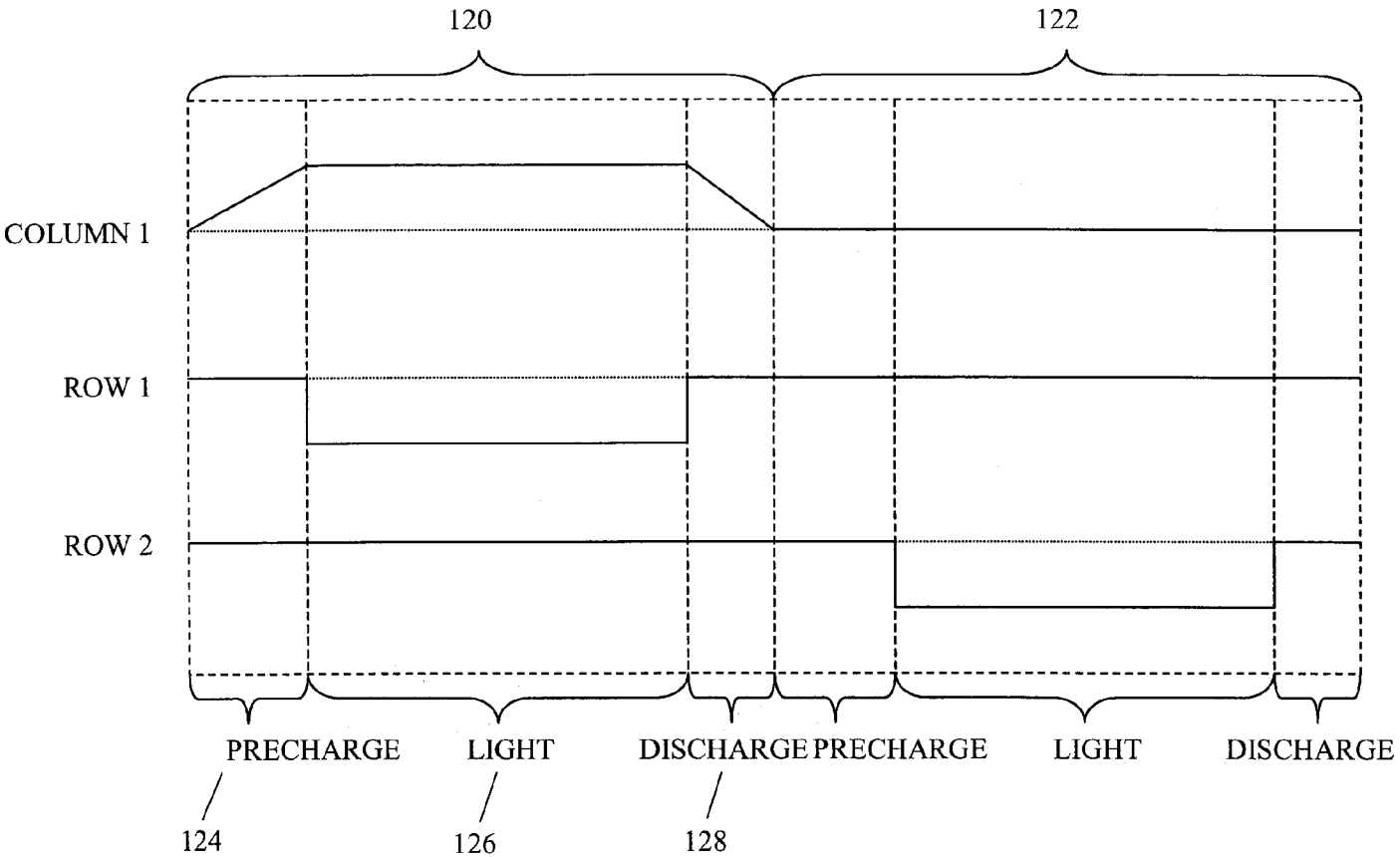
FIG. 7A (PRIOR ART)
FIG. 7*a* is a timing diagram for a typical column and pair of row drive values during two consecutive image fields using a prior art drive method.

As eluded to in the previous discussion, the ability to compensate for capacitive charge within the passive matrix EL display 2, enables a significant change in the method by which these displays are driven without incurring objectionable imaging artifacts. FIG. 7*a* provides a timing diagram of the prior art as discussed by Everitt in U.S. Pat. No. 6,594,606 entitled "Matrix Element Voltage Sensing For Precharge". This timing diagram can be compared and contrasted to FIG. 7*b*, which shows a timing diagram for driving one column electrode and two row electrodes during two subsequent periods that is useful for practicing one embodiment of the present invention. Looking at FIG. 7*a*, it can be seen that each image field 120, 122 is divided into three time intervals 124, 126, and 128. These time intervals provide a time interval 124 for precharging the capacitors of the display 2, a time interval for light emission 126, and a time interval to discharge 128 the capacitors of the display. Note that within these timing diagrams, the act of driving the row electrodes to a low voltage creates a large enough potential between the row and column electrodes to overcome the threshold voltage of the pixel and allow current to flow through the pixel and light to be emitted. Therefore, the light emission period 126 is generally defined by the time that the pixel is capable of conducting current between the column and row electrodes. Within this embodiment, current typically flows from the column drivers through the passive matrix EL display during the charging 124 and lighting 126 periods and then flows out of the display into the driver during the discharge 128 period. The power dissipated during the discharge cycle typically does not result in light emission. The same is true for the power dissipated to the resistance of the row and column electrodes as the power flows into and out of the passive matrix EL display. These losses, therefore, reduce the power efficiency of the display device.

Figure 7B:
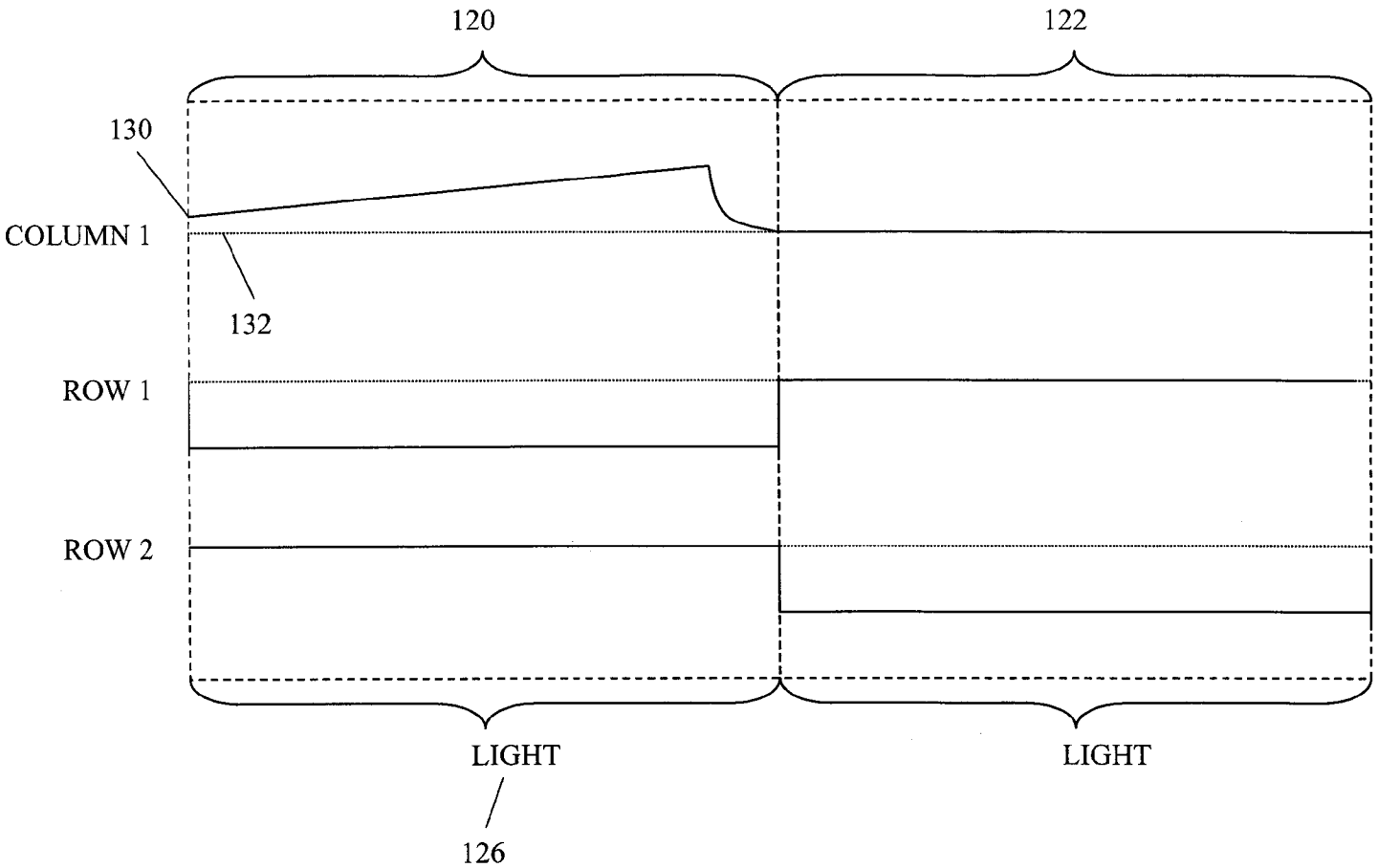
FIG. 7*b* is a timing diagram for a typical column and pair of row drive values during two consecutive image fields in a system of the present invention.

The timing diagram of FIG. 7*a* can be contrasted to the voltage timing diagram shown in FIG. 7*b*. FIG. 7*b* shows a timing diagram for row and column drivers, wherein the column drivers employ a constant current drive method. As shown in FIG. 7*b*, light can be emitted during the entire image field times 120 and 122 as one row electrode is active for the entire time, enabling current to flow through the pixel during the entire image field time. Since the driver employs a constant current drive method, the voltage will generally increase linearly during the drive period until the capacitors of the display are charged, at which time the voltage will typically remain flat. Note that as the capacitive charge of the display is reduced at the end of the first image field time in preparation for the subsequent image field time, the voltage provided will generally decrease exponentially and will approach an aim voltage near the end of the image field time. Also note that the voltage provided to the column electrode does not necessarily need to return to a reference value between image fields and therefore does not require the capacitors of the display to be discharged fully as shown at the end of image field time 120. For example, at the beginning of the first image field 120, the voltage of the column electrode 130 is shown to be above the reference voltage 132. It is worth noting that because the system of the present invention provides light during the entire image field time, the currents that will be required to drive the display device to produce a desirable amount of light will be significantly reduced, which will significantly reduce the power lost to the resistance of the row and column electrodes as this power is a function of the square of the current. Further, since the capacitive charge of the display is not discharged through the column electrodes to ground but instead all flows through the pixels of the display, a larger proportion of the power that is provided to the display results in light emission.

The method as described allows the drive values provided to the row and column electrodes such that any imaging artifact can be avoided, regardless of whether the capacitive charge of a column increases or decreases between image fields. Note that in this method, some bits of the time modulated drive signal may be reserved to reduce or stop the flow of current from the column driver prior to the end of the image field time. The one or more column drivers may, in another desirable embodiment be designed to provide amplitude modulation of current. However, these drivers may also have the ability to reduce or hault the flow of current during the image field time. Once again, the signal may have a couple bits reserved, which may be used to signal the duration over which current is to be provided.

Examples, which require the drive to be adjusted in the initial image field to avoid any loss of contrast even between two successive image fields, occur with a relatively low frequency. Although such displays do often transition between a first image field having a high capacitive charge and a second having a low capacitive charge, often the electrical charge to the second image field can be reduced to at least partially correct for this reduction in capacitive charge between two successive image fields. Under many circumstances, such an adjustment will provide acceptable image quality while avoiding the necessity to charge and discharge the capacitors of the display during subsequent image fields.

In another desirable embodiment, the column drivers may further provide a discharge circuit for discharging at least a portion of the capacitive charge of the display panel. For example, a circuit can be designed to reduce the maximum voltage to a voltage such as the threshold voltage of the pixel. During periods of time that the panel needs to be discharged, this circuit may be activated to help prevent cross talk. In one desirable embodiment, the method described in the previous paragraph may be generally used to reduce the capacitive charge between two successive image fields but the discharge circuit may be activated any time that such a method results in an unacceptable level of imaging artifact.

The one or more column drivers can provide a programmable current or a programmable time interval to modify the electrical charge provided to each pixel. However, in a desirable embodiment of the present invention, the one or more column drivers 6 can provide a time modulated current source for each column. Such time modulated current sources can be constructed using current mirrors as are well known within the art and can exactly control the current provided to each column electrode 10 of the prior art. Such current sources allow a fixed current to be provided to each column electrode of the passive matrix EL display 2 for a programmable amount of time, wherein the luminance output of each pixel is proportional to the time that it is active. Note that the amount of current that can be provided to pixels that provide different colors of light can be different to compensate for differences in efficiencies or other electrical characteristics of these different colors of pixels.

The row drivers can provide a switched voltage, a programmable voltage, or a programmable current sink. However, in one desirable embodiment, the one or more row drivers 4 will provide a programmable current sink for multiple row electrodes which will be used to direct current through multiple active rows of pixels. These one or more row drivers 4 will additionally provide a reference voltage signal, which can be switched to provide a reference voltage to the row electrodes for inactive rows of pixels. This row driver, will allow the active rows of pixels to be selected from among the rows of display pixels by connecting the row electrodes to either the row sinks or to the reference voltage signal. The reference voltage signal will be selected to provide a voltage less than the threshold voltage of the EL light-emitting elements regardless of the voltage provided by the column drivers. The active rows will be programmable to allow different amounts of current to be directed through different row electrodes.

Figure 8:
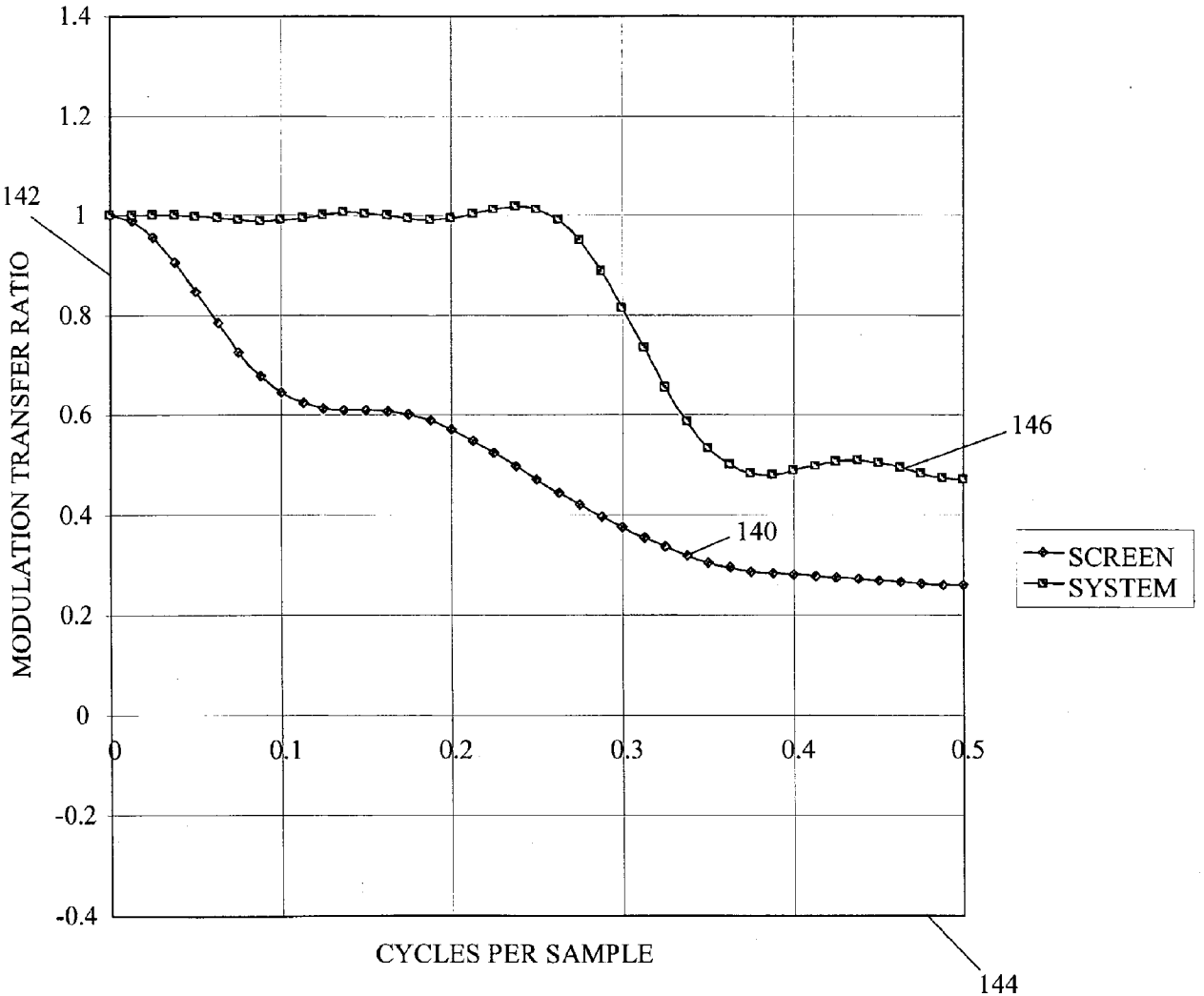
FIG. 8 is a modulation transfer functions for a passive matrix electro-luminescent display system of the present invention.

Using the display driver 8 having the components shown in FIG. 1*a* these row and column drivers can then be used to drive multiple rows of the passive matrix EL display. Within this embodiment, the row electrodes will be driven such that a total of 15 electrodes form a group of row electrodes 24, 26, as shown in FIG. 1 and will be activated simultaneously. The row electrodes will further be driven such that the percentage of current received by each of the row electrodes will be distributed as shown in Table 1. Note that there at least two different drive levels provided in Table 1. In fact, a total of 8 drive levels are shown. Further the drive levels are distributed to have a peak near the center row and to have lower, nonzero values on either side of the peak. That is the peak relative drive value is provided for the center row electrode (i.e. row electrode 8) and lower drive values are provided for row electrodes on either side of this peak. It should also be noted, however, that this function does not decrease monotonically as the distance from the center electrode increases. Note specifically that the drive value for row electrodes 5 and 11 are smaller than the drive values for row electrodes 6 and 10 but larger than the drive values for row electrodes 4 and 12. That is, as the distance from the center electrode increases, the electrode drive values decrease, increase to a secondary maximum at electrodes 4 and 12 and then decrease for the row electrodes in the group of row electrodes. When the row electrodes are driven in this way and this distribution of row electrodes is scanned down the display, the display system will have a native vertical modulation transfer function 140 as shown in FIG. 8. To interpret this function, some characteristics of this modulation transfer function should be explained.

TABLE 1

| Row Electrode Number | Relative Current Values |
|---|---|
| 1 | 0.005 |
| 2 | 0.01 |
| 3 | 0.02 |
| 4 | 0.025 |
| 5 | 0.015 |
| 6 | 0.03 |
| 7 | 0.145 |
| 8 | 0.5 |
| 9 | 0.145 |
| 10 | 0.03 |
| 11 | 0.015 |
| 12 | 0.025 |
| 13 | 0.02 |
| 14 | 0.01 |
| 15 | 0.005 |

First, it should be understood that the modulation transfer function of a perfect display would have a value on the modulation axis 142 of 1 between zero and 0.5 cycles/sample on the frequency axis 144 and a value of zero at exactly 0.5 cycles/sample. Further, if the modulation transfer function crosses the frequency axis at any value lower than 0.5 cycles per sample, spatial information is lost in the image and cannot be recovered. However, if the modulation is decreased, this loss can be compensated through the use of presharpening, although some loss in bit depth can occur. It is also important to recognize that while the modulation transfer function of a perfect display would have a value on the modulation axis 142 of 1 between zero and 0.5 cycles/sample, no practical systems achieve this ideal goal and adequate image quality can be achieved for systems that have values on the modulation axis 142 that are significantly less than 1 for values on the frequency axis 144 that are somewhat less than 0.5.

Figure 9:
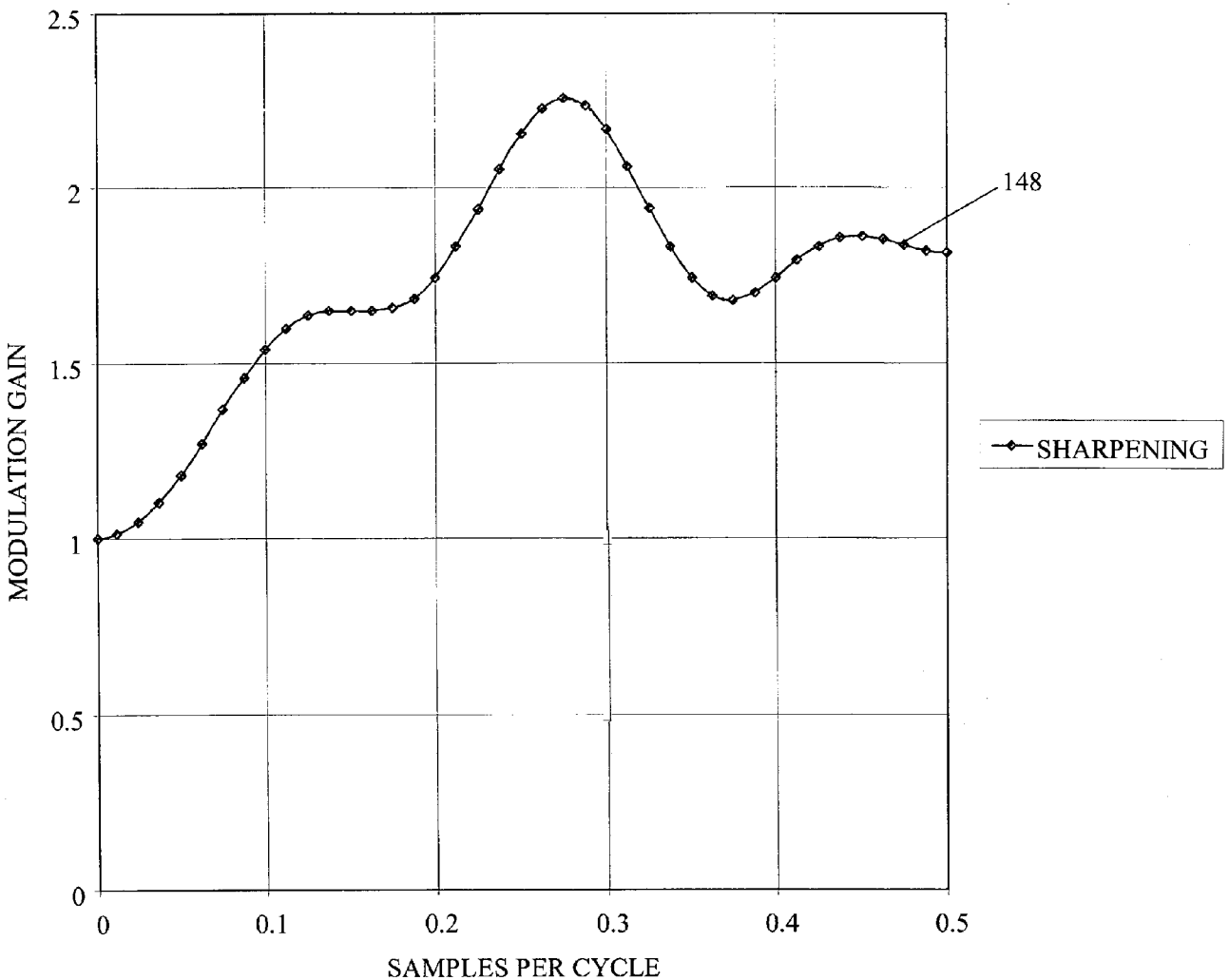
FIG. 9 is a kernel useful in presharpening the input image signal in a multi-line embodiment of the present invention.

The native modulation transfer function 140 of this system is shown in FIG. 8. For the present embodiment of this invention the modulation transfer function 140 crosses the frequency axis 144 at about 0.5 cycles/sample and is positive for all frequencies lower than 0.5 cycles/sample. Therefore, one can use presharpening to restore the modulation of the image at all spatial frequencies that the display can present. In the current invention, this presharpening is accomplished, for example, by applying a vertical presharpening kernel having the values 4, −5, −8, 4, −4, −19, −18, 220, −18, −19, −4, 4, −8, −5, 4, then normalizing the result by dividing the resulting values by 128. FIG. 9 shows the spatial frequency response of this presharpening kernel 148. Note that this presharpening kernel provides a modulation value significantly greater than 1 for all vertical spatial frequencies at which the native modulation transfer function of this system 140 is significantly less than 1 and, therefore, at least partially compensates for the loss of modulation at all spatial frequencies that are attenuated by driving multiple row electrodes according the present invention. After this presharpening kernel is applied, the final system modulation transfer function 146 is greater in modulation than the native modulation transfer function of this system 140 for all spatial frequencies where the native spatial frequency response of the system 140 is less than 1. Simulations performed by the inventors have demonstrated that images having this resulting MTF are quite acceptable and often are visually lossless as compared to images displayed using the one line at a time drive method.

It is worth returning to the discussion of the row drive values shown in Table 1. As noted earlier, these row drive values do not decrease monotonically, but instead contain a valley. The presence of this valley within the row drive values has the result of flattening the system MTF 140 between the spatial frequencies of about 0.1 to 0.2 cycles per sample, creating a plateau within this range of spatial frequencies. The presence of this plateau allows one to obtain values on the modulation axis 142 for these mid-frequencies (i.e., 0.1 to 0.2 samples per cycle) while applying presharpening kernels with relatively small gain values. It is important that the maximum gain value for the presharpening kernel is only 2.26 and would have been much larger had the row drive values declined monotonically from the center row electrode.

By driving multiple rows of pixels in this way, the peak current required to drive any pixel in the display is reduced to 50 percent of the peak value for a traditional one line at a time system. This fact allows the lifetime of EL materials to be extended. By reducing the peak current to 50 percent of that which would be required if one were to employ a traditional 1 line at a time drive method, the maximum current density is also reduced by 50 percent, typically extending the lifetime by something on the order of a factor of 4 or more.

The luminance is linearly related to current in an EL display system, implying that to maintain the luminance of the present display system as compared to prior art solutions, the same time averaged current must be provided through the display system. However, the use of lower peak currents reduces the required voltage to produce this luminance. By reducing the peak drive current, the drive voltage is reduced and since power is computed by multiplying the current and the voltage, the power consumed by the display to produce light is reduced as a function of the peak display current.

Third, in traditional passive matrix display systems employing one line at a time addressing, the row electrodes typically have a significant resistivity and the row currents can be on the order of several hundred milliamperes and, for larger displays, several amperes. Therefore, the loss of power due to $I^2R$ loss along the row electrodes can be significant. By distributing this current over several row electrodes, the current on any single row electrode is reduced significantly and therefore the loss of power due to $I^2R$ loss is reduced significantly, further reducing the power consumption of the display.

It should be noted that in this example, a total of 15 rows were driven simultaneously. Generally, the number of rows that will be driven simultaneously using this method will be five or greater but the method can be applied by driving as few as three lines simultaneously. It should also be noted that the drive level for the center electrode in the group of row electrodes that are driven simultaneously is higher than for any of the other row electrode in the group of row electrodes. Although, one can employ this method by applying two or more center electrodes which all have the same drive values, the method will often employ drive values for the row electrodes furthest from the center that are lower than the drive values for these center electrodes. Further, the drive level will generally decrease for electrodes in the group of row electrodes as the distance from the center row electrode within the group increases. This decrease in drive level can be monotonic such that the distribution of electrode drive values as a function of row electrode location approximates a gaussian function. The fact that the drive values generally decrease with increasing distance from the center electrode is an important attribute since without this attribute, the native spatial frequency response of the system 140 will be zero for a spatial frequencies less than 0.5 cycles per sample and it will therefore be difficult to construct an image having acceptable quality. It is important that the frequency response of a gaussian is a gaussian and such a system modulation transfer function response can be relatively accurately compensated for using traditional presharpening filters. However, interrupting this gaussian by imposing a secondary maximum within each of the tails of the generally gaussian-shaped function for driving the group of row electrodes provides a more advantageous system modulation transfer function. Although this method achieves a 50 percent reduction in peak current, the same general method can be applied to achieve even greater reductions in peak current as more fully described in co-pending U.S. Ser. No. 11/737,786 filed Apr. 20, 2007, entitled "Passive Matrix Electro-Luminescent Display System", which is hereby incorporated by reference.

Once the display processor 8 has created the presharpened signals, the display processor can determine column drive signals and potentially row drive signals. This step can employ operations such as digamma and color matrixing operations to convert the input image signal into a color space that is linear with respect to luminance among other operations.

Within the embodiment of the row and column drivers as discussed, it is important that the current sinks within the one or more row drivers 4 can be programmed to receive proportions of the sum of the current output by the one or more column drivers 6 as indicated in Table 1. It is also possible to program the row drivers to control the proportions of current according to Table 1, by programming them to receive less current than the sum of the current output by the one or more column drivers 6. In such an embodiment, the maximum column driver value can be determined and, if this maximum value is less than is required to form a peak white, the row drivers can be programmed to receive a proportion of the sum of the current to be provided by the column drivers. This proportion can be calculated to be equal to the ratio of the maximum column drive value to the column drive value required to display peak white. At the same time, the timing of the column drivers can be normalized by the inverse of this ratio. As such, the column having the maximum code value will receive current for the entire image field time, reducing the current along every row and column electrode during the image field time and thereby reducing the resistive losses within the EL display. These adjustments to the drive value can therefore also be calculated and each of these can be used by the calculate capacitive charge unit. 46. This unit can then calculate the capacitive charge for two or more consecutive image fields as discussed earlier. A difference between the total charges necessary to compensate for this change in capacitive charge can then be communicated to the adjusting unit 48, which also received the column drive signals. This adjusting unit will then adjust the drive signals and write this data into the output buffer. Also note that the determine column drive signal unit can also form row drive signals and these row drive signals can be provided to the row drive signal generator 58.

Once this processing is completed, the display driver 8 must provide the adjusted image control signal to the column driver 6, which will then provide control signals to the column electrodes 10. In one embodiment, this adjusted image control signal will be written to an output buffer 50 within the display driver 8. A data selector 52 can select data from the output buffer 50 and provide it to the one or more column drivers 6. Synchronously, the row drive signal generator will provide signals to the one or more row drivers 4, indicating the rows that are to be selected and the amount of current that they should receive. It can also be desirable that the row and column drivers share some additional signals as the amount of current to be provided by the column drivers will vary over time and the programmable current sinks of the row drivers must be adjusted as columns are disabled during a image field.

During this last step of providing signals to the row and column drivers from the display driver 8, each subsequent image field can be comprised of either overlapping or non-overlapping groups of row electrodes. However, to reduce the change in capacitive charge, it is desirable that as much overlap as possible be maintained between these groups of row electrodes. Therefore, a first group of rows of light-emitting elements will be simultaneously controlled during a first image field time and a second group of rows of light-emitting elements will be simultaneously controlled during a second image field. The first group of rows of light-emitting elements will overlap the second first group of rows of light-emitting elements with the exception of one row of light-emitting elements, such as to reduce the change in total capacitive charge for any light-emitting element within the display device between the first and second image field time.

It should be noted that in most displays, other image processing must also be performed. For example, in displays employing arrays of RGBW light-emitting elements as described in U.S. patent application Ser. No. 10/320,195, it will be necessary to receive a RGB input image signal, linearize the RGB input image signal with respect to aim display luminance, convert the linearized RGB input image signal into a linearized RGBW input signal. Generally, the method provided in FIG. 3 will be employed after such image processing has been performed. The method in FIG. 3, can be performed on linearized data but can be performed, and often will preferably be performed on nonlinear data in which changes in small code values correspond to smaller changes in luminance than changes in large code values.

The display system of the present invention includes an EL display. This display can be any electro-luminescent display that can be used to form a two dimensional array of addressable elements between a pair of electrodes. These devices can include electro-luminescent layers 8 employing purely organic small molecule or polymeric materials, typically including organic hole transport, organic light-emitting and organic electron transport layers as described in the prior art, including U.S. Pat. No. 4,769,292, issued Sep. 6, 1988 to Tang et al., and U.S. Pat. No. 5,061,569, issued Oct. 29, 1991 to VanSlyke et al. The electro-luminescent layer 8 can alternately be formed from a combination of organic and inorganic materials, typically including organic hole transport and electron transport layers in combination with inorganic light-emitting layers, such as the light-emitting layers described in U.S. Pat. No. 6,861,155 issued Mar. 1, 2005 to Bawendi et al. Alternately, the electro-luminescent layer 8 can be formed from fully inorganic materials such as the devices described in co-pending U.S. Ser. No. 11/226,622 filed Sep. 14, 2005, entitled "Quantum Dot Light Emitting Layer".

The display can further employ row and column electrodes, which are formed from an array of materials. The row electrodes, which typically, carry current to more light-emitting elements that are lit simultaneously, than the column electrodes will typically be formed of a metal. Commonly known and applied metal electrodes include electrodes formed from silver and aluminum. When the electrode functions as a cathode, these metals can be alloyed with low work function metals or used in combination with low work function electron injection layers. At least one of the row or column electrodes must be formed of materials that are at transparent or semi-transparent. Appropriate electrodes include metal oxides such as ITO and IZO or very thin metals, such as thin layers of silver. To decrease the resistivity of these electrodes, additional opaque bus bars can be formed in electrical contact with these electrodes.

The substrate can also be formed of almost any material. When the transparent or semi-transparent electrode is formed directly on the substrate, it is desirable for the substrate to be formed from a transparent material, such as glass or clear plastic. Otherwise, the substrate can be either transparent or opaque. Although not shown, such displays generally will include additional layers for mechanical, oxygen, and moisture protection. Methods of providing this type of protection are well known in the art. Also not shown within the diagrams of this disclosure, are mechanical structures, such as pillars that are commonly employed during manufacturing of passive matrix OLED displays that enable the patterning of the electrode furthest from the substrate.

The invention has been described in detail with particular reference to certain preferred embodiments thereof, but it will be understood that variations and modifications can be effected within the spirit and scope of the invention.

| PARTS LIST | |
|---|---|
| 2 | passive matrix electro-luminescent display |
| 4 | row driver |
| 6 | column driver |
| 8 | display driver |
| 10 | column electrode |
| 12 | row electrode |
| 14 | light-emitting element (pixel) |
| 16 | input image signal |
| 18 | row driver drive signal |
| 20 | column driver drive signal |
| 24 | first group of row electrodes |
| 26 | second group of row electrodes |
| 32 | substrate |
| 34 | first electrode layer |
| 36 | light-emitting layer |
| 38 | second electrode layer |
| 40 | input buffer |
| 42 | presharpening unit |
| 44 | determine column drive signal unit |
| 46 | calculate capacitive charge unit |
| 48 | adjusting unit |
| 50 | output buffer |
| 52 | data selector |
| 54 | programmable memory |
| 56 | timing generator |
| 58 | row drive signal generator |
| 70 | receive input image signal step |
| 72 | determine column drive signal step |
| 74 | calculate value step |
| 76 | adjust column drive signal step |
| 78 | provide column drive signal step |
| 80 | pixels |
| 82 | row electrode resistor |
| 84 | row lead resistor |
| 86 | column electrode resistor |
| 88 | column lead resistor |
| 90 | capacitor |
| 92 | diode |
| 94 | diode voltage to current curve |
| 96 | threshold voltage |
| 100 | end of first image field time |
| 102 | end of second image field time |
| 104 | current amplitude |
| 106 | curve with constant current amplitude |
| 108 | second current amplitude |
| 110 | time second current amplitude ends |
| 112 | relationship for second current amplitude |
| 120 | first image field |
| 122 | second image field |
| 124 | precharge interval |
| 126 | lighting interval |
| 128 | discharge interval |
| 130 | column electrode voltage |
| 132 | reference voltage |
| 140 | native vertical modulation transfer function |
| 142 | modulation axis |
| 144 | frequency axis |
| 146 | final system vertical modulation transfer function |
| 148 | frequency response of presharpening kernel |

The invention claimed is:

1. A method of controlling a passive-matrix, electro-luminescent display having rows and columns of pixels, the method comprising:

receiving an input image signal;

determining drive signals for at least a first image field and a second image field within the input image signal;

calculating the total change in the capacitive charge of the pixels occurring between the display of the first image field and the second image field in response to the change in the input image signal between the first image field and the second image field for each of at least two columns of the passive-matrix, electro-luminescent display;

adjusting the drive signals for each of the at least two columns of the passive-matrix, electro-luminescent display within first or second image fields to compensate for the change in total capacitive charge; and providing adjusted drive signals to each of the at least two columns of the passive matrix.

2. A passive-matrix, electro-luminescent display system for receiving an input image signal, processing such input image signal, and displaying such processed image signal with reduced power consumption, the passive-matrix, electro-luminescent display system comprising:

a passive matrix, electro-luminescent display having an array of column electrodes, an array of row electrodes oriented orthogonal to the array of column electrodes and a thin film electro-luminescent layer located between the array of column electrodes and the array of row electrodes, the intersection of each column and row electrode forming an individual light-emitting element (pixel) having an effective capacitor;

one or more row drivers for receiving current from one or more row electrodes within the array of row electrodes;

one or more column drivers for providing current to the column electrodes within the array of column electrodes to charge the capacitor of the light-emitting elements and provide a drive current to the light-emitting elements; and a display driver for receiving the input image signal and processing this input image signal to provide signals to the one or more column drivers corresponding to the electrical charge to be provided by the column driver during the display of a plurality of image fields, wherein the display driver:

receives the input image signal;

determines column drive signals for at least a first image field and a second image field within the input image signal;

calculates total change in the capacitive charge of the capacitors occurring between the display of the first image field and the second image field for each of at least two columns of the passive-matrix, electro-luminescent display in response to a change in the input image signal between the first image field and the second image field;

adjusts the column drive signals for at least two columns within first or second image fields to compensate for the change in total capacitive charge; and provides adjusted column drive signals for each of at least two columns of the passive-matrix, electro-luminescent display.

3. The passive-matrix, electro-luminescent display system of claim 2, wherein the column driver provides drive signals that do not include a precharge or discharge state.

4. The passive-matrix, electro-luminescent display system of claim 2, wherein the capacitors have a capacitance of at least 50 pF per square mm.

5. The passive-matrix, electro-luminescent display system of claim 2, wherein the capacitors have a capacitance of at least 200 pF per square mm.

6. The passive-matrix, electro-luminescent display system of claim 2, wherein the total thickness of the thin film electro-luminescent layer is less than 5000 A.

7. The passive-matrix, electro-luminescent display system of claim 2, wherein the dielectric constant of the thin film electro-luminescent layer is greater than 2.

8. The passive-matrix, electro-luminescent display system of claim 2, wherein the electric charge provided by a column driver to display one image field is controlled through time division multiplexing.

9. The passive-matrix, electro-luminescent display system of claim 8, wherein the time that the total current is provided during the display of the first image field is reduced to compensate for the discharge of the capacitive charge of a column of the display between the display of a first and second image field.

10. The passive-matrix, electro-luminescent display system of claim 8, wherein the row drivers provide a programmable current sink and wherein this current sink is programmed to control the source current provided by the column drivers.

11. The passive-matrix, electro-luminescent display system of claim 10, wherein the current sinks in the row drivers are programmed to limit the current of the column drivers such that at least one of the one or more column drivers provides a constant current to at least one column electrode for the entire image field time.

12. The passive-matrix, electro-luminescent display system of claim 2, wherein the column driver includes programmable current sources.

13. The passive-matrix, electro-luminescent display system of claim 12, wherein the column driver controls the amplitude of the current to adjust for a change in total capacitive charge of a column of the display between the display of a first and second image field.

14. The passive-matrix, electro-luminescent display system of claim 2, wherein groups of multiple rows and columns of light-emitting elements are simultaneously controlled.

15. The passive-matrix, electro-luminescent display system of claim 14, wherein the row drivers provide separate signals at different times to different groups of row electrodes within the array of row electrodes, such that the row drivers simultaneously provide at least two different level signals to the array of row electrodes.

16. The passive-matrix, electro-luminescent display system of claim 14, wherein during the processing the input image signal to provide column drive signals, the display driver, presharpens the input image signal.

17. The passive-matrix, electro-luminescent display system of claim 14, wherein the luminance output for light-emitting elements within each group of multiple rows of light-emitting elements, is distributed such that the luminance output of light-emitting elements at or near the center of the group of multiple rows, is higher than the luminance output of light-emitting elements of other light-emitting elements, within each group of multiple rows.

18. The passive-matrix, electro-luminescent display system of claim 14, wherein each group of multiple rows of light-emitting elements includes at least three rows of light-emitting elements.

19. The passive-matrix, electro-luminescent display system of claim 16, wherein the luminance output for light-emitting elements within each group of multiple rows of light-emitting elements is distributed such that the luminance output of light-emitting elements decreases, increases, and finally decreases again as the distance from the center of the group of multiple rows of light-emitting elements is increased.

20. The passive-matrix, electro-luminescent display system of claim 14, wherein a first group of rows of light-emitting elements are simultaneously controlled during the first image field time and a second group of rows of light-emitting elements are simultaneously controlled during the second image field time and wherein the first group of rows of light-emitting elements overlap the second group of rows of light-emitting elements with the exception of one row of light-emitting elements, to reduce the change in total capacitive charge for any light-emitting element within the display device between the first and second image field time.

* * * * *